US005167736A

United States Patent [19]

Mei et al.

[11] Patent Number: 5,167,736

[45] Date of Patent: Dec. 1, 1992

[54] NONTOXIC PRIMING MIX

[75] Inventors: George C. Mei, St. Louis, Mo.; James W. Pickett, Gillespie, Ill.

[73] Assignee: Olin Corporation, Cheshire, Conn.

[21] Appl. No.: 787,171

[22] Filed: Nov. 4, 1991

[51] Int. Cl.[5] ..... C06G 43/00

[52] U.S. Cl. ..... 149/22; 149/39; 149/43; 149/68; 149/105

[58] Field of Search ..... 149/22, 39, 43, 68, 149/105

[56] References Cited

U.S. PATENT DOCUMENTS

| | | | |
|---|---|---|---|
| 2,408,059 | 7/1940 | Garfield et al. | 260/141 |
| 4,196,026 | 4/1980 | Walker et al. | 149/46 |
| 4,304,614 | 12/1987 | Walker et al. | 149/46 |
| 4,363,679 | 12/1982 | Hagel et al. | 149/37 |
| 4,581,082 | 4/1986 | Hagel et al. | 149/105 |
| 4,608,102 | 8/1986 | Krampen et al. | 149/92 |
| 4,675,059 | 6/1987 | Mei | 149/43 |
| 4,963,201 | 10/1990 | Bjerke et al. | 149/2 |

*Primary Examiner*—Stephen J. Lechert, Jr.
*Attorney, Agent, or Firm*—John R. Wahl

[57] ABSTRACT

A nontoxic primer mix for use in a percussive primer, especially of the Boxer type which principally comprises diazodinitrophenol and boron. The composition may also contain calcium carbonate or strontium nitrate as an oxidizer, a nitrate ester as a fuel, and tetrazene as a secondary explosive.

9 Claims, No Drawings

NONTOXIC PRIMING MIX

BACKGROUND OF THE INVENTION

1. Field of the Invention

This invention generally relates to primers and more particularly to a lead and barium free priming composition for use in ammunition.

2. Description of the Related Art

Various lead free priming mixtures for use in ammunition have been disclosed over the years. For example, my nontoxic, noncorrosive Priming mix described in U.S. Pat. No. 4,675,059 is one such composition. This priming composition is specifically adapted to rim fire cartridges and contains diazodinitrophenol, also known as dinol or DDNP, manganese dioxide, tetrazene and glass.

Another example of a nontoxic priming mixture is U.S. Pat. No. 4,963,201, issued to Bjerke et al. This composition comprises dinol or potassium dinitrobenzofuroxane as the primary explosive, tetrazene as a secondary explosive, a nitrate ester fuel and strontium nitrate as the oxidizer.

Other examples are disclosed in U.S. Pat. Nos. 4,363679 and 4,581,082, issued to Hagel et al. In these patents, the initiating explosive may be salts of trinitroresorcinol or salts of trinitrophenol, metallic salts of mono- and dinitrodihydroxydiazobenzenes and salts of hydrazoic acid, and metal-free compounds such as diazodinitrophenol, nitroform phenoldiazonium, tetrazene, or nitrogen tetrasulfide. Zinc peroxide is utilized as the sole or predominant oxidant. Zinc peroxide is a powerful oxidizer. However, it is an inefficient one. Only one oxygen atom per molecule is available for oxidation reactions. It is also difficult to get zinc peroxide in pure form. The result is reduced gas output and a cool flame with high slag content in the combustion product.

Another nontoxic primer mix is disclosed in U.S. Pat. No. 4,608,102 to Krampen. This mix has manganese dioxide as an oxidizer with dinol. The manganese dioxide, like zinc dioxide, is a powerful oxidizer but is inefficient and has the same drawbacks as the mix in Hagel et al.

These nontoxic mixes are less sensitive than the lead styphnate compositions. Therefore the metal parts configuration of the primer must be carefully optimized to ensure reliable ignition. This can only be done consistently in the Berdan primer system where the primer anvil is part of the cartridge and the primer factory installed under rigorously controlled conditions. Thus these nontoxic mixes are preferably used in Berdan type primers. Cartridges which use Berdan primers are not reloadable as the anvil is an integral part of the cartridge case. Also, the primer case is not readily removable and the primer cavity cannot adequately be cleaned after use.

Boxer type primers, on the other hand, contain the anvil within the primer cup and therefore require only a simple cavity in the casing head to receive the primer cup. The cavity is easily cleaned and the cup readily removed with a suitable punch. The Boxer type primer is thus used in reloadable ammunition and, understandably, is preferred by avid competition shooters.

Accordingly, there is still a need for a sensitive, clean burning, efficient Priming mix that is nontoxic to humans and can be used in Boxer type primers that are widely used in reloadable cartridges today.

DESCRIPTION OF THE INVENTION

Surprisingly, it has been discovered that a composition comprising principally dinol and boron provides a nontoxic composition for Boxer primers. Other ingredients may be added to tailor the specific output of the primer. For example, dinol, boron, calcium carbonate and a nitrate ester fuel, a double base propellant such as Ball Powder ® propellant, is a suitable nontoxic primer composition for use in Boxer type primers.

More specifically, the composition of the invention may contain diazodinitrophenol as the initiating explosive, tetrazene as a secondary explosive, boron as an abrasive agent and fuel, calcium carbonate as the oxidizer, and a nitrate ester fuel such as PETN, nitrocellulose, or gun powder as a secondary fuel.

The core of the present invention is the combination of dinol and boron. The boron sensitizes the mix in two respects. First, the boron is a very hard abrasive agent which is harder than antimony sulfide or calcium silicide. Second, it is a strong reducing agent, stronger than aluminum, antimony sulfide, or calcium silicide, the other reducing agents currently used. Its strong reducing potential permits the use of weaker but more efficient oxidizers rather than dioxides or peroxides of zinc or manganese.

The sensitizing effect of boron is so great that oxidizers such as the carbonates can now be used in addition to such known oxidizers as strontium nitrate. Carbonates such as calcium carbonate and magnesium carbonate are not normally considered as oxidizers in Priming compositions. The oxidizer of choice is calcium carbonate because it is insoluble in water and is completely nontoxic.

The mix of the invention is sensitive enough that the presence of tetrazene is not essential. The mix is sensitive enough in most applications without tetrazene and the sensitizing effect of the boron can be controlled to a great extent by the choice of its particle size. The coarser the particle size is, the more sensitive the mix will be. For example, with a boron particle size of about 120 mesh, the mix is sensitive enough to be used in rimfire ammunition (which does not contain tetrazene) without the need for ground glass. In addition, the mix needs no other fuels such as aluminum, titanium, calcium silicide, or antimony sulfide (though these materials may be included for other considerations). An additional advantage of using boron as a fuel is that boron has a high calorific content. Thus it is possible to formulate a mix with an output in terms of flame temperature, gas output, impulse, and hot particles, etc. comparable to the traditional lead styphnate based mixes.

The mix of the present invention can be used directly in Boxer type components without any modification. This is of particular importance because shooters can reload ammunition with this type of primer without having to buy primed cases. Finally, the mix of the invention forms nontoxic products including calcium oxide and boron oxides. The boron oxides combine with water to form boric acid, an anticeptic eye wash.

The priming composition used for small arms primers must possess a certain range of sensitivity to mechanical shock or impact. This sensitivity is measured by dropping a predetermined weight a given height onto a firing pin on a test primer. Groups of 50 primers are usually tested to get a prediction of the sensitivity. The groups are tested at different drop heights in order to obtain a measure of the No Fire, 50% Fire, and All Fire levels for the primer. SAAMI (Small Arms and Ammunition Manufacturers Institute) requirements are no fire below a one inch height and all fire above 11 inches drop height for small pistol primers.

The present production acceptance requirement at Winchester for Boxer type primers is an All Fire drop height of 8.1 inches with a 1.94 ounce ball. This test is an industry production standard test. The mix according to the present invention falls well within this requirement as shown by the examples below.

EXAMPLES

A percussion-sensitive Priming composition for use in boxer type primers was prepared which consisted of 45% by weight dinol having a partical size of about 20–30 microns, 5% by weight tetrazene having a grain size of about 100 mesh, 10% calcium carbonate (reagent grade having a grain size of 270 mesh), 15% boron powder (reagent grade having a particle size of 325 mesh) and 25% WC350 Ball Powder ® propellant. Dry mixing was utilized in order to obtain a small quantity of a uniform, free flowing mixture. A wet mixing process would be utilized on a production scale. The tetrazene, calcium carbonate, and WC350 propellant were first dry mixed together. The dinol, prepared in accordance with the procedure in U.S. Pat. No. 2,408,059, incorporated herein by reference, was then added to the dry mixture. Finally, the boron was added and water was introduced to make a wet mix. The water content of the wet mix was about 22%.

This wet mix was then screened onto a multiperf plate to form pellets of the mixture. These pellets were then inserted into Winchester ® #108 primers, dried and then assembled. 500 of the primers were prepared as above described. 50 were randomly selected and tested with the following sensitivity results: At a drop height of 4 inches, none of the primers fired. At a drop height of 6 inches, all primers fired. At a height of 5 inches, about 80% fired.

The following mixes were also prepared as described above and subjected to an impact test.

1. 45% dinol, 5% tetrazene, 10% calcium carbonate, 25% double base propellant (WC350), and 15% boron.
2. 47% dinol, 26% WC350 Ball Powder ® propellant, 16% boron, and 11% calcium carbonate.
3. 47% dinol, 16% boron, and 37% WC350 Ball Powder ® propellant.

This impact test involved placing about 1–2mg of the dried mix onto an anvil and dropping a 1.5 Kg weight 8 cm onto the anvil and observing whether the mix sample detonated. Each of the compositions above readily detonated with no evidence of degradation of sensitivity.

Tetrazene is not necessary as an explosive sensitizer when boron is used as shown by the second and third examples above. The third mix above contains neither a sensitizing explosive nor a separate oxidizer. Such a mix may be an excellent candidate for commercial primer applications and clearly illustrates the contribution of boron to a primer composition containing dinol.

A still further example without tetrazene which uses strontium nitrate as the oxidizer is 45% dinol, 15% double base propellant, 10% boron, and 25% strontium nitrate. In general, strontium nitrate may be substituted for the calcium carbonate in the above described examples with similar results in sensitivity due to the presence of the boron as fuel and abrasive sensitizer. Thus strontium nitrate may be used as an oxidizer in a range of from about 5% to about 50%.

The mix in accordance with the invention may consist of 25% to 75% dinol, 0 to 25% tetrazene, 2% to 30% boron, 0% to 30% metal carbonate, and 0% to 30% auxiliary fuel such as PETN, gun powder, hexanitromannitol, antimony sulfide, calcium silicide, or nitrocellulose, or other nitrate ester fuel depending on the application.

The boron in the composition of the present invention may have an additional advantage. It produces boric oxide as its combustion product. Boric oxide combines rapidly with moisture, also produced in the combustion process, to make boric acid. Boric acid is environmentally harmless and nontoxic. In addition, boric acid can act as a lubricant. Thus the composition of the invention may be a self lubricating primer composition which may tend to inhibit ammunition component and barrel wear.

It is to be understood that the above described embodiments of the invention are illustrative only. Modifications throughout may occur to those skilled in the art. Accordingly, it is intended that the invention is not to be limited to the embodiments disclosed herein but is defined by the scope and fair meaning of the appended claims. All patents, patent applications and other documents specifically referred to above are incorporated herein by reference in their entirety.

What is claimed is:

1. A nontoxic primer composition comprising diazodinitrophenol and boron.

2. The nontoxic primer composition of claim 1 further comprising a nitrate ester fuel.

3. The composition of claim 2 further comprising calcium carbonate as an oxidizer.

4. The primer composition of claim 3 further comprising tetrazene as a secondary explosive.

5. The primer composition according to claim 3 wherein said diazodinitrophenol is in a range from about 25% to about 75%, said boron is in a range from about 2% to about 30%, said calcium carbonate is in a range from about 0% to about 30%, and said nitrate ester is in a range of uP to 30%.

6. A primer composition comprising diazodinitrophenol, boron, a nitrate ester fuel, and strontium nitrate as an oxidizer.

7. The primer composition according to claim 7 further comprising tetrazene.

8. The lead-free priming composition according to claim 2 wherein the oxidizer is calcium carbonate.

9. The primer composition according to claim 7 wherein said diazodinitrophenol is in a range from about 25% to about 75%, said boron is in a range from about 2% to about 30%, said nitrate ester fuel is in a range from about 0% to about 30%, and said strontium nitrate is in a range from about 5% to about 50%.

* * * * *